United States Patent [19]

Keller et al.

[11] 4,061,389

[45] Dec. 6, 1977

[54] COMBINATION WIRE LINE RELEASABLE OVERSHOT AND PULL TOOL

[76] Inventors: V. J. Keller, P.O. Box 847, Channelview, Tex. 77530; William T. Taylor, 222 Camp Lilly Road, Humble, Tex. 77338

[21] Appl. No.: 594,330

[22] Filed: July 9, 1975

[51] Int. Cl.[2] ..... E21B 31/12

[52] U.S. Cl. ..... 294/86.3; 285/360; 175/315; 294/86.28; 294/86.29; 294/86.33

[58] Field of Search ..... 285/360; 403/13; 294/86.3, 86.17, 86.18, 86.28, 86.33, 86.32, 86.24, 86.26, 96, 102, 86.1, 86.19, 86.20, 86.25, 86.29, 86.30, 86.31, 86.34; 166/125, 88, 89, 99; 175/315; 24/263 PP, 249 VL, 249 DP

[56] References Cited

U.S. PATENT DOCUMENTS

| | | | |
|---|---|---|---|
| 2,250,463 | 7/1941 | Boynton | 403/13 |
| 2,301,377 | 11/1942 | Craig et al. | 294/86.3 |
| 2,687,323 | 8/1954 | Stohn | 294/86.31 |
| 2,745,693 | 5/1956 | McGill | 294/86.31 |
| 2,814,523 | 11/1957 | Stohn | 294/86.31 |
| 2,893,491 | 7/1959 | Crowe | 175/315 |
| 3,211,479 | 10/1965 | Brown | 285/360 |
| 3,628,822 | 12/1971 | Bostock | 294/86.33 |
| 3,960,399 | 6/1976 | Dufrene | 294/86.2 |

*Primary Examiner*—James B. Marbert
*Attorney, Agent, or Firm*—Donald Gunn

[57] ABSTRACT

A wire line oil tool adapted for multiple connectors on the bottom. It can be used as an overshot, a fishing neck grapple or an inside grapple. It incorporates an outer body which is annular about a central member. A catch mechanism locks the outer body up or down relative to the inner body. The catch mechanism enables the tool to operate on jarring. On jarring, the two parts move relatively to an up or down position. In the down position, the appendages at the bottom of the tool open to engage a fishing neck or the like. In the up position, it is latched or held. If retrieval of the tool is impeded, subsequent jarring will reverse the catch mechanism and release the fishing neck. The device is particularly adapted to be used on wire line retrieval and running operations. In the event an item is grasped which cannot be retrieved, subsequent jarring will achieve release and retrieval of the tool.

13 Claims, 7 Drawing Figures

COMBINATION WIRE LINE RELEASABLE OVERSHOT AND PULL TOOL

BACKGROUND OF THE INVENTION

In wire line operations, wire line retrieval and installation tools are commonly used. Most items which are installed in a tubing string are equipped with API standard fishing necks. A standard fishing neck normally includes an undercut shoulder to enable grappling by installation or retrieval tool. Quite often the API standard fishing neck will wear away so that only a stub pipe without an undercut shoulder is left. Retrieval of this sort of device is implemented by an overshot such as that manufactured by Bowen. A common drawback in the installation and retrieval tools of the past is the inability of the operator to undo the connection achieved by the tool. For instance, a wire line equipped with a Bowen overshot can be used to grasp a device installed in a tubing string in a fishing job. However, the device to be retrieved may sometimes stick and the wire line operator is unable to retrieve it on the wire line. A substantially heavier wire line may be required. The Bowen overshot is difficult to disconnect from the stub which it has engaged. Occasionally disconnection can be achieved by substantial jarring which will sometimes shear a pin. Reconstruction and reassembly of the tool at the surface is then required to repair the harm done by this step. Retrieving tools other than the named model suffer similar infirmities. Once they latch onto an item to be pulled or retrieved, substantial problems exist in selective downhole disconnection. Should a fishing job utilizing a certain weight of fishing equipment begin, it is almost impossible to disconnect the apparatus from the fish and substitute heavier equipment. As a consequence, retrieval of the fishing equipment itself compounds the problem.

The apparatus of the present invention is particularly adapted to overcome these difficulties. It can be used in a fishing job with various adaptors on the lower end to enable it to enable an API standard fishing neck, a worn fishing neck which then resembles a stub member, or an inside grappling job. In all these adaptations, the upper portion of the tool remain the same. The upper portion of the tool is able to be latched or actuated on a first jar. Should it be impossible to retrieve the fish in question, a second jar will release the fish so that the tool can be retrieved and a heavier gauge device be used.

SUMMARY OF THE INVENTION

The present invention is a wire line operated tool particularly adapted for use below a jar which incorporates an outer tubular body and an inner body. The outer body is movable in location relative to the inner body. Sliding movement of the tool actuates or reverses external and internal grapples on the lower end and a fishing neck retrieval mechanism. The tubular outer body is secured about the inner body by means of a catch mechanism. The catch mechanism has two positions, up and down. One is used to lock and the other is used to unlock the connected apparatus. The catch mechanism is preferably duplicated on opposite sides of the tool. The catch mechanism utilizes a pin on the interior of the tubular sleeve which projects inwardly into a groove which describes a closed circuit. A ball in the groove moves between selected positions to lock the pin in the up or down position.

DESCRIPTION OF THE PREFERRED EMBODIMENT

Figure 1:
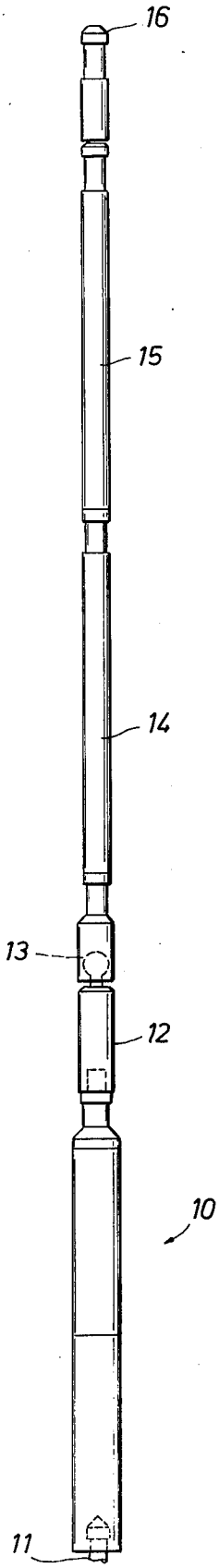
FIG. 1 shows the tool of the present invention installed with associated apparatus for running on a wire line.

In FIG. 1, the retrieval tool 10 is shown just above a fishing neck 11 to be retrieved. Other adaptations of the tool 10 will be described. It is connected to a threaded sub 12 which connects with a knuckle joint 13 which pivots, enabling a jar 14 to be connected thereabove. Suitable weights 15 are connected above the string of equipment. It is all adapted to be run on a wire line which connects with a wire line socket 16. The jar 14 sets and unsets the retrieval tool of the present invention. The weights 15 are helpful in running the apparatus on a wire line in a tubing string. The supportive apparatus shown is normally installed with the retrieval tool although variations in the rigging of the wire line equipment are readily accomplished.

Figure 2:
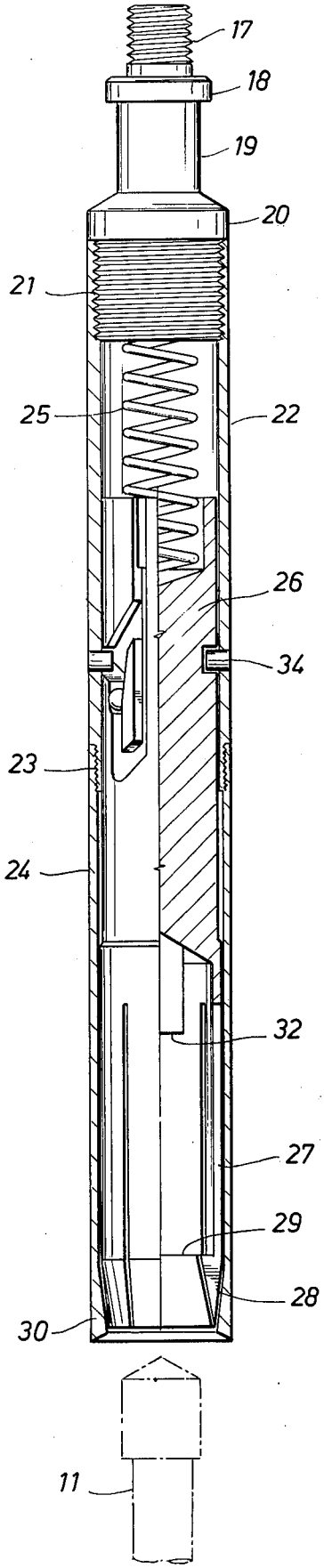
FIG. 2 is an axial sectional view through the tool of the present invention particularly illustrating a catch mechanism cooperative with an outer sleeve and inner body.

In FIG. 2, a threaded sub 17 above a collar 18 enables the tool 10 to be joined to cooperative equipment. The collar 18 is above the neck 19 of reduced diameter. This provides a fishing neck in the event the tool 10 becomes disconnected with the cooperative apparatus. The neck 19 extends to an enlargement 20 connected to a threaded sub 21.

The sub 21 is threaded on its exterior and is joined to a tubular member 22. The outer tubular member 22 is of substantial length. It terminates at a set of threads 23 which engage a lower outer cylindrical member 24 which is of equal diameter of the outer annular member 22. The two members make up the exterior of the tool when they are threaded together. The member 24 can be removed. The tool 10 will be described as illustrated in FIG. 2, and alternative embodiments using a different sleeve attached at the threads 23 will be set forth.

The tubular member 24 provides an internal chamber where a spring 25 is positioned. The spring 25 is compressed, and bears against a solid member 26. The member 26 is generally cylindrical, although it is countersunk to receive the spring 25. The solid member 26 is threaded to or integrally formed with a set of flexible collet fingers 27. The collet fingers extend downwardly to pass over the fishing neck 11. The collet fingers extend substantially along a portion of the outer tubular sleeve 24. The collet fingers are preferably defined by uniformly spaced slots cut along the length of the tubular member which thereby defines the collet fingers. Each finger terminates at an internal enlargement 28. The enlargement 28 is undercut with an upwardly facing shoulder 29. The shoulder 29 is adapted to engage the downwardly facing shoulder on the fishing neck 11. The knuckle 28 tapers to a lower edge on its lower end. The knuckle 28 tapers to a thicker portion adjacent to the shoulder 29. This provides substantial metal in the collet fingers to engage and grasp the fishing neck 11.

The collet fingers 27 are parallel to one another and form lengthwise elements of a right cylinder. The sleeve 24 thereabout is concentrically arranged and is also a right cylinder. However, the lower end of the sleeve 24 is enlarged at 30 so as to define an internal tapering surface adjacent to the knuckles 28. The taper is about twelve degrees in the preferred embodiment although other taper angles can be utilized. The taper is gradual, and firmly engages the knuckles and forces them inwardly. In the up position of FIG. 2, the collet fingers 27 flex outwardly, thereby releasing the grasp of the tool 10 on the fishing neck 11. When the collet fingers move downwardly, the enlargement 30 contacts the knuckles 28 with the tapered surface which forces them inwardly, thereby mating the shoulder 29 against the cooperative shoulder of the fishing neck. Depth of penetration of the fishing neck in the position of FIG. 2 is limited by means of a cylindrical bumper 32. The bumper 32 is arranged near the upper end of the collet fingers.

Figure 3:
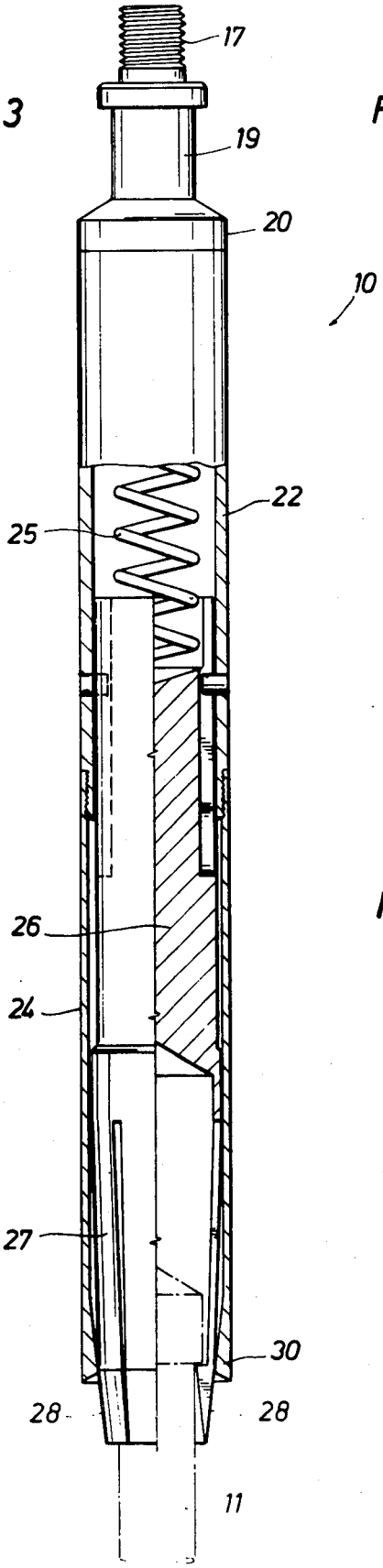
FIG. 3 is a view similar to FIG. 2 contrasting the latched and unlatched position and particularly illustrating apparatus appended to the lower end which engages a fishing neck.

Before completing a description of the tool shown in FIG. 2, it would be helpful to define the relative up and down positions. FIG. 2 illustrates the collet fingers 27 in the up position relative to the enlargement 30 which forces them inwardly. This is the release or engage position. In this position, the collet fingers are in their relaxed, outer position. They are unable to grasp the fishing neck 11. In contrast, FIG. 3 shows the collet fingers in the relative down position. The enlargement 30 which presents a tapered internal face forces the knuckles 28 radially inwardly toward the fishing neck 11. The shoulders lock beneath the fishing neck, thereby enabling retrieval of the fishing neck 11 and anything connected to it. FIG. 3 illustrates the relative down position, the retrieval position.

Returning to FIG. 2, the apparatus includes a catch mechanism which catches when the tool is in the up and down positions. The outer sleeve 22 supports a pin 34 which extends radially inwardly. Two identical catch mechanisms are shown. One will function adequately, or three can be used as desired. Symmetry of operation and enhanced strength is attained by duplicating the catch mechanism.

Figure 4:
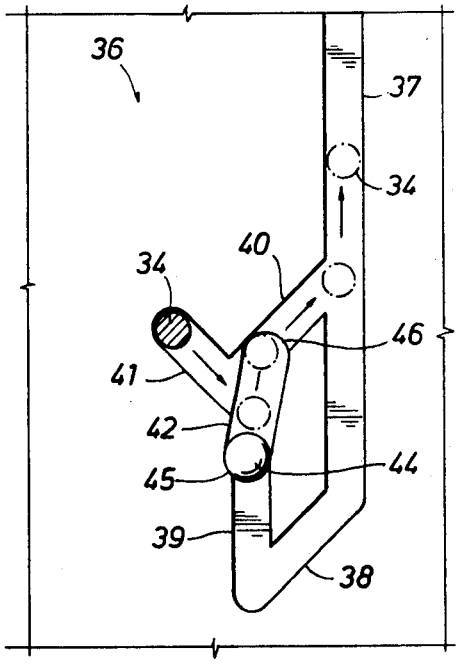
FIG. 4 is a detailed view of the pin and groove arrangement partly illustrated in FIG. 2 and illustrating alternative positions of the pin whereby the apparatus is latched in one of two positions.
Figure 5:
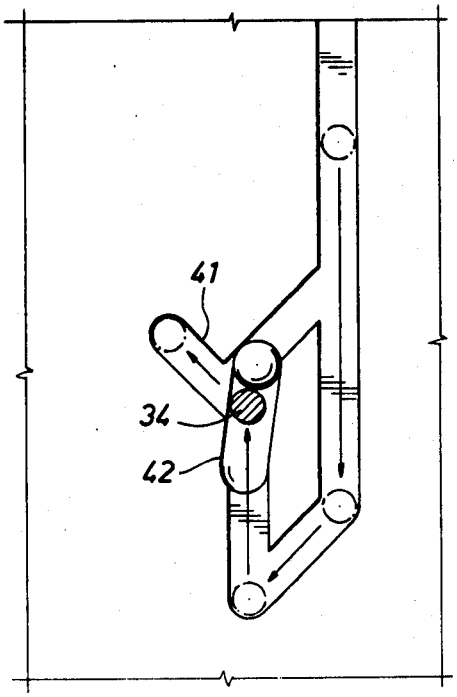
FIG. 5 is a view similar to FIG. 4 showing a ball movable in the groove to deflect the pin to a locked position.

For a description of the catch mechanism 36, attention is directed to FIGS. 4 and 5. FIG. 4 is a partial face view of the exterior surface of the inner solid member 26, and includes the catch mechanism 36. A groove 37 which is parallel to the axis of the member 26 is cut in the face. The groove is sufficiently deep and wide to receive the pin 34 for lengthwise sliding movement. The groove 37 extends downwardly and deflects to the left at the portion 38. Another groove portion 39 is parallel to the groove 37. The groove portion 38 is parallel to another groove portion 40 which connects between the grooves 37 and 39. All of the grooves described in this juncture enable the pin 34 to move through the grooves.

A dead end groove portion 41 is shown in FIG. 4. It connects with the groove 39. Notweorthy, the grooves 39 and 41 are joined by an enlarged groove 42. The groove 42 is slightly wider than all the other grooves. It is wider to receive a locking ball 44. The ball 44 is limited in its movements to the groove 42. Its lowermost position is shown in FIG. 4 where locking ball 44 is in the downwardmost extent of the groove 42, and locks against a shoulder 45. The shoulder 45 catches the locking ball 44 but no other part of the mechanism described. The groove 42 extends to an upper locking shoulder 46. The shoulders 45 and 46 at the ends of the larger grooves 42 for catching the locking ball in the extremity of movement permitted to it. The ball 44 is normally found wedged against either the shoulder 45 or the shoulder 46.

The ball 44 is capable of moving to the upper shoulder 46 to lock against it. This is shown in FIG. 5. The pin 34 is also shown travelling into the groove 42. The ball is so located that the pin contacts it and is deflected to the left into the groove 41 which is a dead end. The groove 41 extends at an angle and the pin 34 is deflected at that angle into the groove 41 by the locking ball.

Viewing FIGS. 4 and 5 jointly, the pin 34 has only two permitted positions. The first is in the vertical groove 37. This coincides with the down position of FIG. 3. The pin 34 is also shown in FIG. 4 in sectional view in the dead end groove 41. This corresponds with the locked or up position of FIG. 2.

In FIGS. 4 and 5 jointly the path of the pin 34 is shown. It begins at some point in the vertical or lengthwise groove 37. When the oil jar or mechanical jar 14 above the tool is operated, the inertial upset relatively moves the outer sleeve 22 downwardly, carrying the pin 34 from the top dotted line position of FIG. 4 in the groove 37 all the way down to the groove 38. The momentum of movement of the parts is sufficient to cause the pin 34 to deflect at the angular groove 38. It moves to the bottom point of the groove 38. At this juncture, the extremes of movement have been accomplished. The pin 38 is constrained in movement. The spring 25 forces the solid member 26 relatively downward, or causes the pin 34 to move relatively upward as viewed in FIG. 4. It moves up in the groove 39. The ball 44 is in the down position, held there by gravity. The pin 34 moves in the groove 39 up against the ball. It is spring impelled in this movement. The ball 44 is quickly jammed against the upper shoulder 46. When it is jammed against that shoulder, the pin 34 continues its generally upward movement. It is limited in movement by the lock ball 44 and is deflected somewhat to the left by the round surface of the ball. When deflected to the left, it moves into the dead end groove 41. When it moves into this groove, it travels to the upper end of the groove 41 under the urging of the spring 25. It bangs against the upper end of the groove and is further limited in movement and remains there indefinitely. This is the position associated with the latched position of FIG. 3.

Later, the position of FIG. 2 is achieved as follows. The jar 14 is again operated. The inertial upset imparted to the tool forces the pin 34 downwardly in the passage or groove 41. At this time, however, the lock ball 44 is in the down position. When the pin 34 previously moved into the dead end groove 41, the ball 44 fell by gravity to the downmost position. The pin 34 moves along the passage 41 into the enlarged passage 42. After the inertial upset is terminated, the pin moves upwardly as viewed in FIG. 4. It encounters the shoulder defining the wall of the groove 40 and moves along the groove 40 back into the groove 37. It moves upwardly limited by the engagement of the tapered enlargement 30 at the lower end of the tool as shown in FIG. 3. The pin 34 does not move to the extreme upper end of the groove 37 because of this limitation. The position of the grasping mechanism on the fishing neck 11 shown in FIG. 3 is achieved when the pin 34 moves to the groove 37. Its upper travel is limited in this manner.

The groove 37 extends all the way to the upper end of the solid member 26 for ease of assembly. Separation of the parts by gravity is not permitted because of the action of the lower end of the tool as shown in FIG. 3.

Figure 6:
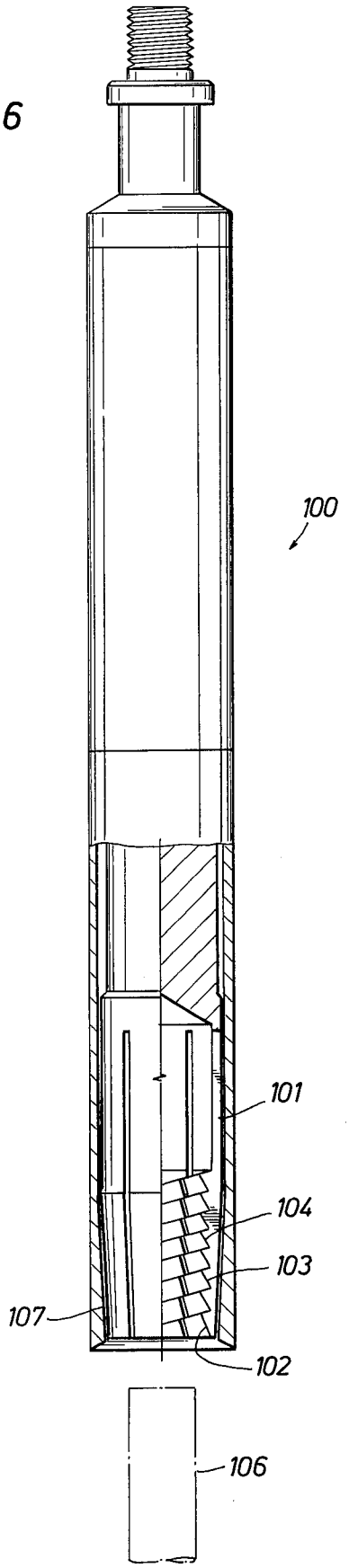
FIG. 6 is an alternative view showing an internal grapple mechanism.

From the foregoing, it will be understood how the apparatus described is able to grasp and release a fishing neck. Attention is next directed to FIG. 6 where a modified form of the tool is shown at 100. The threaded tubular member 24 is not modified. A new set of collet fingers 101 are incorporated. They do not include a single large shoulder 28, but rather several shoulders 102, 103 and 104 are included on each collet finger. When considering all of the collet fingers together, the interior describes a spiralling shoulder or helix thread. This is particularly adapted to engage a worn fishing neck, a cylindrical stub, or tubular member such as the one illustrated at 106. The several shoulders all cooperate to grasp the stub body 106. The taper 107 in the outer hollow tubular sleeve is perhaps longer to bring a greater portion of the collet fingers into contact with the worn fishing neck 106.

Figure 7:
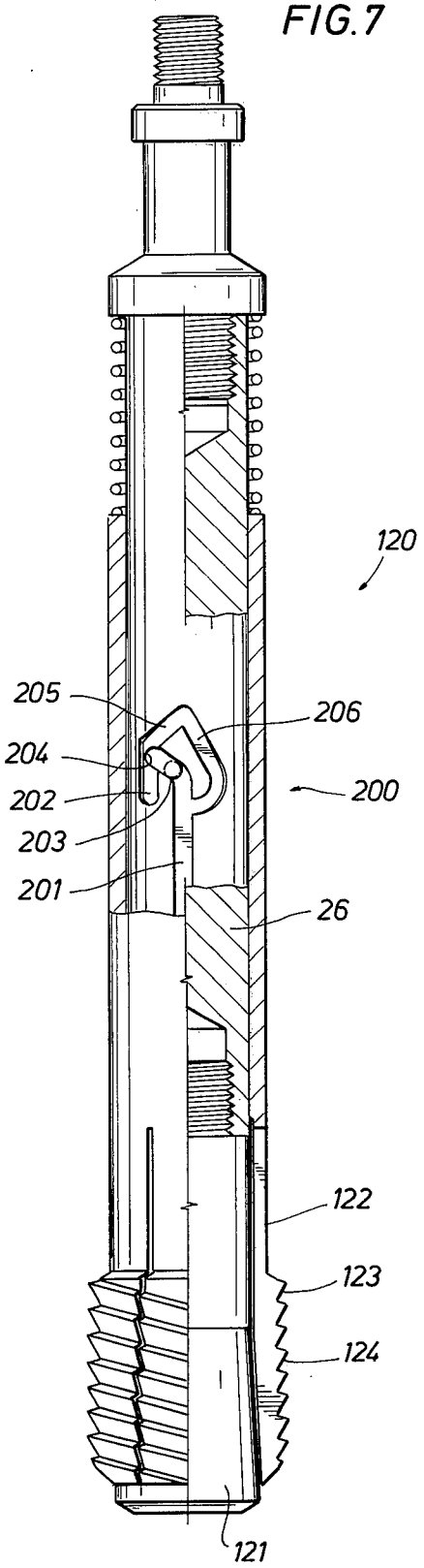
FIG. 7 is a view similar to FIG. 6 showing an external grapple mechanism.

FIG. 7 shows an internal grapple mechanism. The solid tubular member 26 is joined to a solid lower member 121 in the tool 120. The internal grapple incorporates an external sleeve which is threaded to the upper sleeve 22. The external lower sleeve is cut into several collet fingers 122. The collet fingers collectively are externally threaded. Each collet finger carries several shoulders at 123, 124 and so on. The solid member 121 has a relatively long taper beneath the collet fingers. When the solid member 121 moves upwardly the collet fingers 122 are forced outwardly, enabling the internal grapple to grab and hold the interior of a pipe.

The tool of the present invention has been described with three connective tools appended to the lower end. The term connective tool refers to an apparatus which performs a downhole operation such as releasing or retrieval of an item with a fishing neck. It functions well in retrieval as illustrated. It is able to retrieve a fish of the sort which can be pulled free. In retrieval or fishing, it is uniquely able to engage the fish while enabling the user to pull on the wire line connected to the tool. The tool connects to the fishing neck and then releases it should a heaver line be required. Connection and release are achieved by jarring with sufficient impact or momentum to operate the catch means shown in FIGS. 4 and 5.

FIG. 7 is to be contrasted with the other drawings. The catch means, as that term is used in the claims, is inverted or upside down relative to the remainder of the tool. The catch means 200 includes a slot 201 which extends downwardly to the bottom of the solid tubular member 26. It is not necessary that it extend further. It extends to this location to enable the radially inwardly directed pin 34 to be inserted into it. The pin 34 is carried on the outer slidable tubular sleeve which terminates at the collet fingers 122. The pin is moved up through the longitudinal slot 201 on assembly of the outer tubular sleeve. The outer tubular sleeve would normally drop off the tool 120. It is kept on the tool by means of the tapered parts at the bottom which prevents the outer sleeve from sliding off the tool. It is forced downwardly by the spring at its upper end.

The pin 34 travels on a controlled route determined by the catch means. The dead end portion is found at 202. The groove has a closed route which includes the curved groove portion 203 which bends somewhat to the left. That groove portion communicates with a groove 204 which is deeper and wider, and is able to receive the lock ball 44 previously described. The lock ball is limited in travel to the deeper groove 203. It moves to the upper left to a blocking position forcing the pin 34 into the dead end groove 202. It moves by falling down and to the right, but it is not permitted to enter the longitudinal groove 201 because that groove is cut with a smaller profile. It has a more shallow depth and is more narrow.

The pin that travels into the dead end groove 203 emerges therefrom by traveling through the groove 205 and then to the groove portion 206. It is forced from the groove portion 206 downwardly into the groove 201. It travels somewhat downwardly in the groove 201 as viewed in FIG. 7 under urging of the spring, but it does not go to the bottom of that groove because the collet fingers 122 at the bottom engage the tapered mandrel 121 to stop downward movement of the outer tubular sleeve.

The cycle can be repeated indefinitely. The catch means of FIGS. 7 provides the pin with two stable locations, one in the dead end groove portion 202 and the other in the groove 201. It functions in a similar fashion to the catch means shown in other views.

The ball moves by gravity in the deeper groove 204. It moves to the left hand position where it is aligned with the dead end groove 202 and in a blocking position therefor, and it moves back to the top end of the groove 201, but it does not enter that groove as previously specified.

The catch means, as that term is used in the claims, refers to the mechanism which enables the body and surrounding mandrel to be guided in axial movement and limited to the two preferred operative positions. The two positions which are most significant are those associated with latching and unlatching, as illustrated in FIGS. 2 and 3. The latching and unlatching positions occur in any sequence. Thus, an installation job involves latching the tool 10 to a gas lift valve (as an example) at the surface which is then run into a tubing string. The valve is located and the tool 10 is unlatched and retrieved while leaving the valve in the tubing string.

A fishing job entails running the tool 10 into a tubing string to find a fish. It is jar-operated to latch onto the fish whereupon the tool and fish are both retrieved. In the event the fish is stuck and defies retrieval with the size of equipment used, the tool 10 is unlatched and retrieved. Even a third and heavier set can then be used.

The present invention thus is intended for use with downhole tasks which require latching and unlatching. The variety of downhole connective tools has not been exhausted. In particular, they include those which are slide action operated between the preferred two positions described in the foregoing description. While more modifications could be stated, the scope is determined by the claims which follow.

We claim:

1. A releasable down hole tool operable on a wireline, comprising an elongate tubular body adapted to run in a well bore;

an out mandrel slidably positioned about said body;

a connective tool for achieving a down hole operation on relative movement of said body and said mandrel;

a catch means operable on lengthwise movement and cooperative with said body and said body and said mandrel to selectively and releasably repetitively secure said body and said mandrel in first and second relative movement to said connective tool which further operates repetitively between the first and second relative lengthwise positions, each operation occurring on lengthwise movement of said tool and wherein said catch means comprises 1. a groove means formed in said body;
2. a pin carried on said mandrel and captured in said groove means for movement confined therein;
3. wherein said groove means is constructed and arranged in a closed loop enabling repetitive movement as said pin traverses said closed loop; and
4. including means for limiting movement of the pin in said closed loop groove means to traversing said closed loop groove means in a single direction.

2. The apparatus of claim 1 including a spring means urging said body and said mandrel toward the first position.

3. The apparatus of claim 1 wherein said connective tool is connected operatively to said body and said mandrel, and is actuated by said relative lengthwise movement.

4. The apparatus of claim 1 wherein said groove means is constructed and arranged to define a second position for said body relative to said mandrel to maintain said connective tool in a second and different state.

5. The apparatus of claim 1 wherein said connective tool includes a set of collet fingers having an internal shoulder wich fingers are arranged in a generally encircling arrangement to encompass a fishing neck;

a sleeve encircling said collet fingers and having a tapering internal diameter adapted to contact said collet fingers to move them radially inwardly so as to clasp a fishing neck; and, said collet fingers and said sleeve being cooperatively connected to said body and said mandrel for sliding relative movement to cause said collet fingers to move radially inwardly.

6. The apparatus of claim 5 wherein said collet fingers are formed by a plurality of longitudinal slots in a tubular member and each of said fingers terminates in an enlarged portion having an internally located shoulder.

7. A releasable down hole tool operable on a wireline, comprising an elongate tubular body adapted to run in a well bore;

an out mandrel slidably positioned about said body;

a connective tool for achieving a down hole operation on relative movement of said body and mandrel; and, a catch means operable on lengthwise movement and cooperative with said body and said mandrel to selectively and releasably repetitively secure said body and said mandrel in first and second relative movement to said connective tool which further operates repetitively between the first and second relative lengthwise positions, each operation occurring on lengthwise movement of said tool and wherein said catch means comprises a pin in a closed loop groove means with one being supported by said body and the other being supported by said mandrel, and said groove means includes a dead end portion where said pin may enter on relative axial movement between said body and said mandrel as a means for limiting pin movement to a single direction in said groove means.

8. The application of claim 7 wherein said pin is guided into the dead end portion of said groove means by a sphere sized to be caught and maintained in a specified portion of said groove means and where the sphere and said groove means are cooperatively sized to defind and limit reverse movement of said pin in said groove means.

9. The apparatus of claim 7 wherein said groove means includes first, second and third portions wherein said first portion is generally parallel to the axis of said body, said second portion is a dead end portion entered by said pin on movement of said pin from said first portion and which dead end prevents further axial relative movement of said body and said mandrel, and said third portion enables controlled movement of said pin from said dead end portion to said first portion for subsequent return to said dead end portion where said locking position is achieved.

10. The apparatus of claim 7 wherein said connective tool includes a set of collet fingers arranged in a circle;

serrated gripping means on a face of said fingers; and, first means adjacent to said gripping means for moving said fingers along a radial line of the circle to carry said gripping means into engagement with a downhole item.

11. The apparatus of claim 10 wherein said gripping means are on the exterior face of said fingers and said first means includes a tapering plug inside the circle of said fingers which is constructed and arranged to move axially of said fingers to flex them outwardly.

12. The apparatus of claim 10 wherein said gripping means are on the interior face of said fingers and said first means includes a tapering sleeve around the circle of said fingers which is constructed and arranged to move axially of said fingers to flex them inwardly.

13. The apparatus of claim 10 wherein said serrated gripping means includes a shoulder cut in a helix about said fingers collectively.

* * * * *